US010377563B1

(12) United States Patent
Childress et al.

(10) Patent No.: US 10,377,563 B1
(45) Date of Patent: Aug. 13, 2019

(54) TWO-PIECE SHIPPING CONTAINER WITH VERTICAL LOCKING SYSTEM

(71) Applicant: Cakeboxx Technologies, LLC, McLean, VA (US)

(72) Inventors: Louis Deak Childress, Lynchburg, VA (US); Daine Eisold, McLean, VA (US)

(73) Assignee: Cakeboxx Technologies, LLC, McLean, VA (US)

( * ) Notice: Subject to any disclaimer, the term of this patent is extended or adjusted under 35 U.S.C. 154(b) by 569 days.

(21) Appl. No.: 15/202,669

(22) Filed: Jul. 6, 2016

Related U.S. Application Data

(60) Provisional application No. 62/259,104, filed on Nov. 24, 2015.

(51) Int. Cl.
*B65D 88/12* (2006.01)
*B65D 90/00* (2006.01)
*B65D 88/10* (2006.01)

(52) U.S. Cl.
CPC ..... *B65D 90/0026* (2013.01); *B65D 88/121* (2013.01); *B65D 90/008* (2013.01); *B65D 90/0033* (2013.01)

(58) Field of Classification Search
CPC ..... B65D 90/0026; B65D 88/121; B65D 90/0033; B65D 90/008
USPC ..... 220/1.5, 625
See application file for complete search history.

(56) References Cited

U.S. PATENT DOCUMENTS 2,556,418 A 6/1951 Del Mar
2,920,781 A 1/1960 Butcher
3,027,025 A * 3/1962 Tantlinger ..... B60P 1/6418 280/9
3,042,227 A 7/1962 Tantlinger
3,088,619 A 5/1963 Boucher
3,261,493 A 7/1966 Smith
3,294,429 A * 12/1966 Halip ..... A47G 1/10 40/782
3,374,915 A 3/1968 Verhein
3,529,741 A 9/1970 Walker
3,568,912 A 3/1971 de simas
3,584,757 A 6/1971 Blaisdell
3,602,376 A 8/1971 DePiano
(Continued)

FOREIGN PATENT DOCUMENTS

DE 20201657 U1 6/2002
FR 2956859 A1 9/2011
GB 2089768 A 6/1982

*Primary Examiner* — J. Gregory Pickett
*Assistant Examiner* — Niki M Eloshway
(74) *Attorney, Agent, or Firm* — James Creighton Wray

(57) ABSTRACT

A two-piece intermodal shipping container has a deck and a lid. The deck has vertical lock corner casings bottom corner castings, a frame and a floor. Tie down clips or rings are provided on side and end beams around a floor that is recessed in one embodiment. The lid has side beams and corner posts with upper and lower corner castings. Twist locks are held in the vertical lock corner casings. After loading and securing cargo on the deck, the lid is lowered over the cargo to the deck. The twist locks are turned to secure the lower corner castings on the lid with the vertical lock corner casings on the deck, completing the shipping container for placing or stacking the container on a truck, train, ship or airplane. The deck has fork lift openings in the frame. The lid has fork lift tubes or lifting rings at the top.

18 Claims, 6 Drawing Sheets

(56) References Cited

U.S. PATENT DOCUMENTS

| | | | | |
|---|---|---|---|---|
| 3,760,970 | A | 9/1973 | Lutz | |
| 3,797,691 | A | 3/1974 | Williams, Jr. | |
| 3,853,238 | A | 12/1974 | Luisada | |
| 3,872,555 | A | 3/1975 | Link | |
| 3,908,852 | A | 9/1975 | Ricobene | |
| 4,010,990 | A | 3/1977 | Rowley | |
| 4,015,715 | A | 4/1977 | Kelf | |
| 4,120,415 | A * | 10/1978 | Hopkins | B30B 9/3042 220/315 |
| 4,209,887 | A | 7/1980 | Saunders | |
| 4,355,732 | A | 10/1982 | Nessfield | |
| 4,360,115 | A | 11/1982 | Saunders | |
| 4,416,385 | A | 11/1983 | Clare | |
| 4,546,896 | A | 10/1985 | Reid | |
| 4,809,851 | A | 3/1989 | Oestreich, Jr. | |
| 4,936,451 | A | 6/1990 | Shuert | |
| 5,516,172 | A * | 5/1996 | Ehrlich | B65D 88/121 220/1.5 |
| 8,002,134 | B2 | 8/2011 | Whyte | |
| 9,920,512 | B1 * | 3/2018 | Eisold | E04H 1/04 |
| 2002/0007602 | A1 * | 1/2002 | Corcoran | B65D 88/121 52/122.1 |
| 2007/0246466 | A1 | 10/2007 | Whyte | |
| 2008/0029510 | A1 * | 2/2008 | Fisk | B65D 88/022 220/7 |
| 2014/0231422 | A1 * | 8/2014 | Kochanowski | B65D 90/008 220/1.5 |
| 2016/0101931 | A1 * | 4/2016 | Disorbo | B65D 88/12 220/1.5 |
| 2016/0288993 | A1 * | 10/2016 | Hu | B65D 88/528 |
| 2017/0305658 | A1 * | 10/2017 | Su | B65D 88/022 |

* cited by examiner

TWO-PIECE SHIPPING CONTAINER WITH VERTICAL LOCKING SYSTEM

This application claims the benefit of U.S. Provisional Application No. 62/259,104, filed Nov. 24, 2015, which is hereby incorporated by reference in its entirety as if fully set forth herein.

SUMMARY OF THE INVENTION

The invention includes a two-piece (deck and lid) intermodal marine, highway, rail and air transportable, ISO 668 and 1496 compliant shipping container having two primary components—the deck and the lid fastened together with vertical locking systems with twist locks and corner castings at the four corners of the container deck and lid.

The two-piece container has the following features:

Scalable designs are capable of being produced in but not limited to all industry standard sizes including: 20', 40', 45', 48', 53' lengths, 8' and 8'6" widths, and 4'3", 4'9", 8', 8'6" and 9'6" heights.

A lid or top section is comprised of but not limited to industry standard steel construction with corrugated steel sides, end panels, and roof panel, side beams, corner posts, corner castings at all eight corners to permit handling and lifting, moving, lowering and stacking by all standard container handling equipment.

The lid can be fitted with fork tubes or lifting rings in the lid to permit the lifting of only the lid by a fork lift or other lifting device.

The lid can be constructed without doors or with cargo and access doors of varying sizes at either end or both ends.

The bottom surface of the lid can be fitted with a flexible seal to maintain watertight integrity of the interior A deck or base section is comprised of but not limited to industry standard steel construction side rails, end rails, cross members, steel or plywood floor. Corner castings are installed at lower four corners The deck is constructed to be used independently as a platform or pallet and can be used with or without the lid attached.

The deck can be outfitted with one or more sets of fork tubes to allow it to be picked up by a fork truck in either a loaded or unloaded condition A vertical locking system installed at each corner of the deck component is mounted above and supported by the lower corner castings. The vertical locking system has twist lock devices with operating handles mounted inside reinforced housings.

In operation, the twist locks in the deck top corner castings engage lower corner castings at each of four corners of the lid component. When the handle is rotated, the twist lock in the deck locks securely inside the corner casting in the lid and holds the two components together as one unified unit. Physical locking devices on vertical lock handles prevent accidental opening and attempted theft.

The floor of the deck can be made of but is not limited to either a flat steel, wood or plywood or a recessed steel construction.

The floor is outfitted or surrounded with recessed or surface mounted tie-down points or D-rings when used collectively are know as the Perimeter Tiedown System™.

The invention allows shippers to load any type of cargo directly to the deck of the two-piece container without having to pass the cargo through width and height restricted door openings. By providing this capability of sides, ends or top loading of cargo onto an open deck, shippers can now ship cargo in a completely enclosed intermodal shipping container.

Shippers previously had to ship large items as deck cargo or on an uncovered flat rack-type platform. That left the cargo unprotected and subjected to theft or the elements. Alternatively, shippers had to disassemble items in order to pass them through the door opening. Further, when cargo is end loaded through the doors of a normal shipping container, the cargo is frequently not properly secured, due to lack of room for cargo handlers to get inside with the cargo loaded.

With its Perimeter Tiedown System installed, this invention permits the complete and thorough securing of the cargo load from outside the container while the lid is removed. Once the cargo is properly secured, the lid can be reinstalled, and the container and cargo are ready for transport. In any instance, cargo can be loaded and unloaded in a far more expedient manner than with a typical single unified piece rear-doored container. The ability to load from the top or from the sides or ends also reduces the probability of damage to the cargo and to the container itself.

This two-piece container also provides an increase level of security in many ways. When the two-piece container is configured without access or cargo doors, the cargo is virtually immune to external tampering, vandalism and theft. The cargo cannot be accessed without removal of the lid. If fitted with access doors, the cargo load may be far larger than the door opening and cannot be removed from the container.

The standard single piece rear door loading shipping containers make the level of effort to load large, awkwardly shaped cargo time consuming and dangerous, and subsequently provide, after loading, inadequate means of securing the cargo inside the containers.

This invention improves loading time, securing cargo and container safety. When not outfitted with access or cargo doors, the two-piece container provides a far greater level of physical security to the cargo inside, and this deters, inhibits or limits the probability of cargo theft, vandalism or smuggling.

The new recessed floor option provides shippers with additional vertical space that is not available in typical end-loading doored containers.

Throughout the specification and claims the "corner castings" are meant to include "corner fittings". Corner fittings may be made of welded plates and have form and function identical to corner castings.

The new two-piece intermodal shipping container has a deck and a lid. The deck has a frame with deck vertical locks at upper corners of the deck, and a floor connected to the frame. The lid has a bottom surface for engaging the deck and lid lower corner castings at bottoms of the lid corners.

The lid lower corner castings are alignable with the deck vertical locks when joining the lid and the deck. The vertical locks connect and secure the lower corner castings of the lid to the vertical locks of the deck.

The lid further has a lid frame having corner posts connected to the lower corner castings. Upper corner castings are connected to tops of the corner posts opposite the lower corner castings. Side and end beams interconnect the corner posts. Side, end and roof panels are connected to the corner posts. In one embodiment, one of the end walls has lockable cargo doors connected to the corner posts. Fork lift tubes are connected to the lid frame near upper portions of the lid member.

In one example, the floor is recessed in the deck and is surrounded by the side and end beams. Cargo tiedown points or rings are connected to the floor or to the side and end beams of the deck to secure cargo on the deck. The deck bottom corner castings are alignable and are connectable with intermodal shipping container connectors on marine, land, rail and air carriers or with upper corner castings on lids of the new two-piece containers or with upper corner castings of conventional intermodal shipping containers when the new containers are stacked with other new containers or conventional containers. The lid and deck connectors have twist locks permanently installed in the vertical lock housings on the deck. The deck vertical lock housings and bottom corner castings are connected together.

The new intermodal shipping deck has a frame with corners and side beams. The side beams of the frame of the deck member have fork lift openings. End beams are connected between ends of side beams and cross members connected between the side beams. A floor is mounted on the cross beams. Corner structures are connected to the side beams and the end beams at the corners of the frame. The corner structures of the deck frames have vertical lock housings and bottom corner castings at lower ends of the corner structures. The bottom corner castings are connectable to carriers and to upper corner castings of intermodal shipping containers.

The floor is recessed in one example of the new deck and is surrounded by the side and end beams. Cargo tiedown points or rings are connected to the side and end beams or to edges of the floor to secure a load on the deck.

Twist locks are permanently installed in the vertical lock housing of the deck for selectively moving between engaging and connecting and disengaging and disconnecting the lower corner castings of the lid with the vertical lock structures of the deck. The twist locks lock when engaging and connecting the lower corner castings of the lid with the top corner castings of the deck.

These and further and other objects and features of the invention are apparent in the disclosure, which includes the above and ongoing written specification, with the claims and the drawings.

BRIEF DESCRIPTION OF THE DRAWINGS

FIG. 1 shows a birds-eye view of two-piece container with both pieces fit together as one. The container appears as a secure storage apparatus.

FIG. 2 is a view of how the two pieces look when separated. The lid is lifted vertically from the deck, a method avoiding damage that would result from horizontally sliding off of the lid.

FIG. 3 is a view of how the two pieces look separated, showing the deck component free and without any inhibiting sides preventing the loading of large or uniquely shaped cargo.

FIG. 4 is a final exploded view of the two-pieces separated and next to each other.

DETAILED DESCRIPTION

FIGS. 1-4 are perspective and exploded views of the two-piece container 10 with the vertical locking system 50 and a recessed floor 24 in the deck 20.

Figure 1:
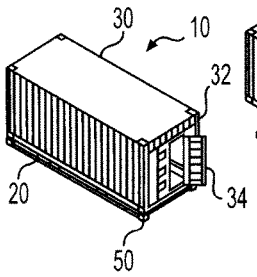
FIGS. 1-4 are perspective and exploded views of the two-piece container with the vertical locking system and recessed floor.

FIG. 1 shows the complete two-piece container 10 with a deck 20 and a lid 30. One end 32 of lid 30 has vertically hinged doors 34 for cargo handling and inspection. Doors 34 may be eliminated or may be provided at both ends of the lid.

Figure 2:
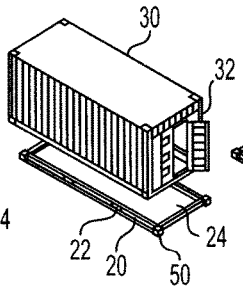

FIG. 2 shows deck 20 unlocked from lid 30 and the lid slightly raised from the deck. The deck 20 has fork tubes 22 and has a recessed floor 24 for increasing floor to ceiling height inside the container.

Figure 3:
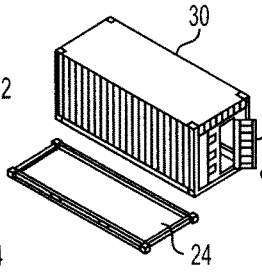
Figure 4:
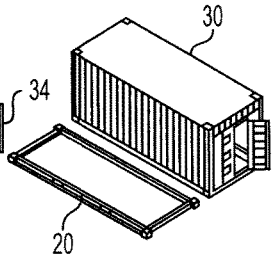

FIGS. 3 and 4 show the raised lid 30 being displaced sideways from the deck 20. Placing the lid 30 to a side of the deck 20 facilitates loading cargo on the deck from either end or either side. Placing the lid 30 away from the deck 20 provides easy access for moving cargo onto or off the deck and for access to the tie-downs for securing the cargo straps and nets to rings and mountings along sides and ends of the deck 20.

Figure 5:
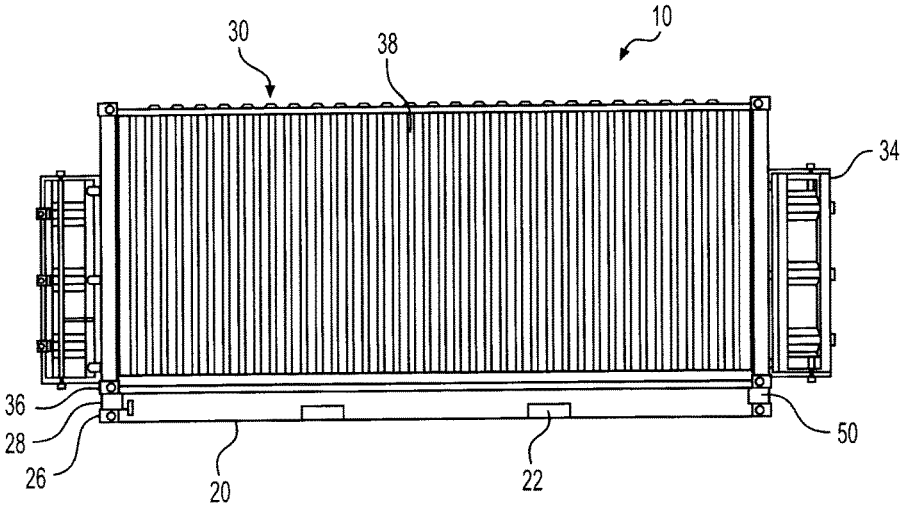
FIG. 5 is a side elevation of the new two-piece shipping container with the vertical locking system. Doors on either end panel allow easy access to load additional cargo without necessitating the two pieces be detached. The doors also allow convenient access to the cargo already within the container.

FIG. 5 is a side elevation of the new two-piece shipping container 10 with the vertical locking system 50. The deck 20 and lid 30 are secured at upper corners 28 of the deck and lower corners 36 of the lid. Lower corner castings 26 cooperate with carriers or with other containers. Access doors 34 are shown at both ends of the lid 30. Deck 20 has fork tubes 22 for moving the deck or the entire container 10 with a forklift. Doors 34 on lid 30 are shown opened for access to an interior of the container. Lid 30 has corrugated steel side panels 38 and internal side beams.

Figure 6:
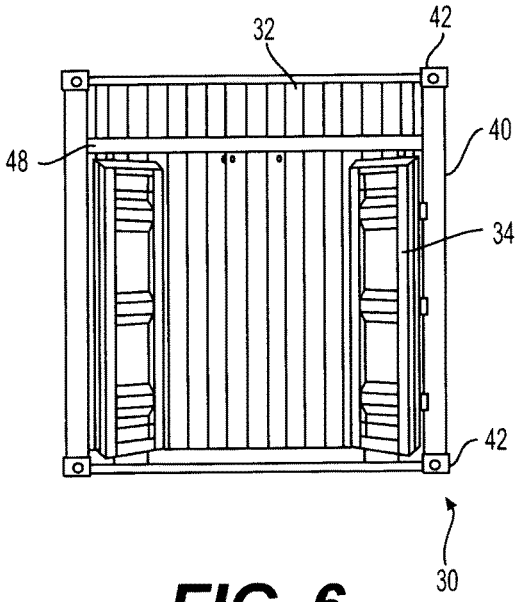
FIG. 6 is an end elevation of the lid component with doors at one end, providing a wide enough opening to accommodate additional cargo of size less than the door frames. The doors slide open and closed smoothly along their bottom frame.

FIG. 6 shows the lid component 30 with doors 34 at one end 32. Corner posts 40 are welded to corner castings 42 at all eight corners of the lid 20. Side and end beams are joined to the corner posts, and door supporting beams 48 are welded to the corner posts.

Figure 7:
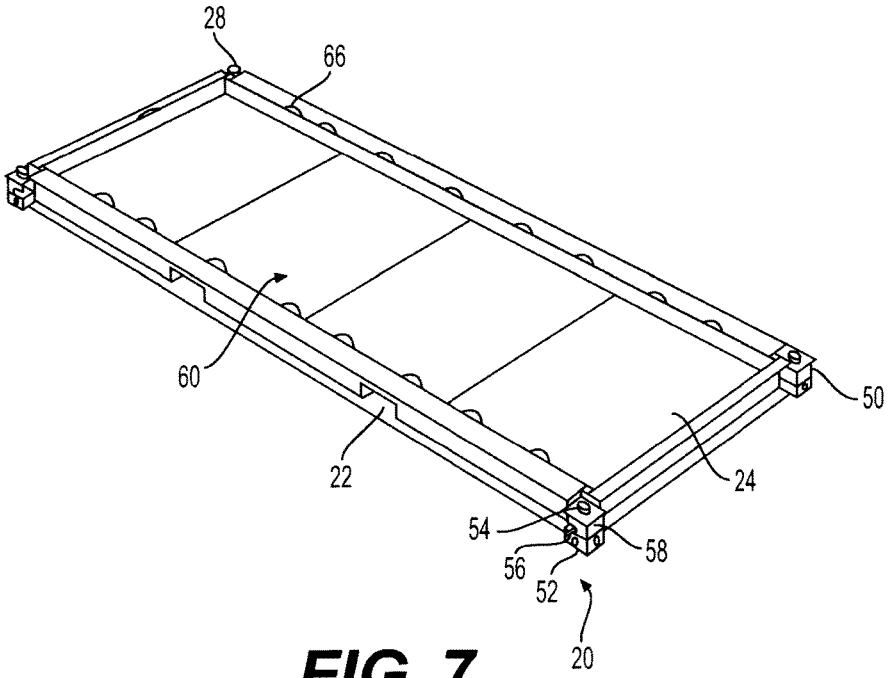
FIG. 7 is a perspective view of the deck component with a recessed floor and vertical locks. The lowered floor accommodates taller loads, and the partially elevated sides prevent the sliding off of loaded cargo before the lid is attached.

FIG. 7 shows the deck component 20 with a recessed floor 24 and vertical locks 50. The deck 20 or base section is comprised of but not limited to industry standard steel construction side rails, end rails, cross members, steel or plywood floor. Corner castings 52 are installed at lower four corners 28 of the deck The deck 20 is constructed to be used independently as a platform or pallet and can be used with or without attaching the lid.

The deck 20 can be outfitted with sets of fork tubes 22 to allow it to be picked up by a fork truck in either a loaded or unloaded condition A vertical locking system 50 is installed at each corner of the deck component 20. The vertical locking systems 50 are mounted above and are supported by the lower corner castings 52. The vertical locking systems have twist lock devices 54 with operating handles 56 mounted inside reinforced housings 58.

In operation, each twist lock 54 in the deck 20 engages a corner casting 42 at each of four lower corners of the lid component 30. When the handle 56 is rotated, the twist lock 54 in the deck 20 locks securely inside the corner casting 42 in the lid 30 and holds the two components together as one unified unit 10.

The floor 60 of the deck component 20 can be made of but not limited to either a flat steel or plywood floor or a recessed steel construction floor 24.

The floor 60 is outfitted with or without recessed or surface mounted tie-down points 66 or D-rings, which when used are known collectively as the new Perimeter Tiedown System™. The Perimeter Tiedown System is not available in ordinary end door loaded cargo containers, where the cargo that has been loaded restricts access to inner sides of the containers.

Figure 8:
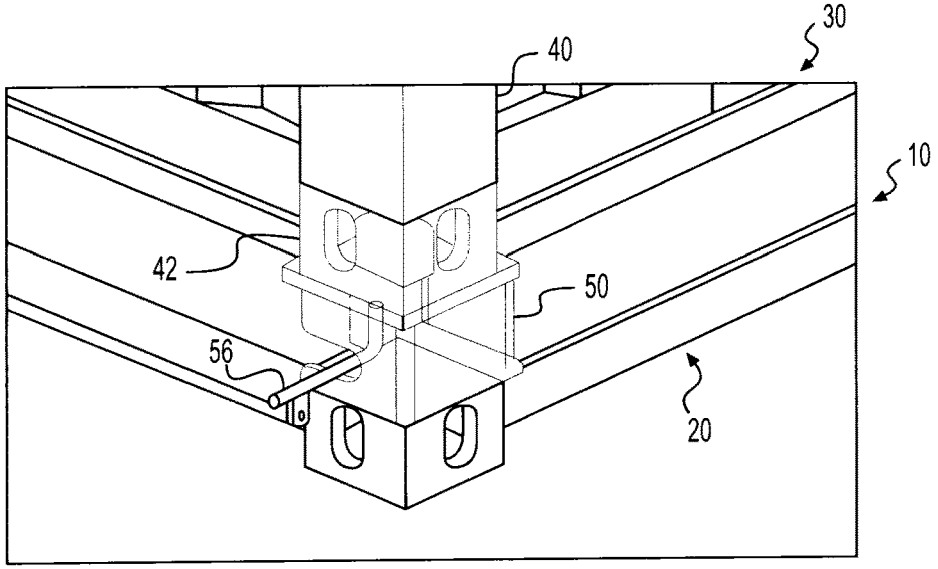
FIG. 8 is a perspective detail of a corner of the new two-piece container with a vertical lock in unlocked position. It shows the straightforward, simple yet secure mechanism for holding the lid in place.
Figure 9:
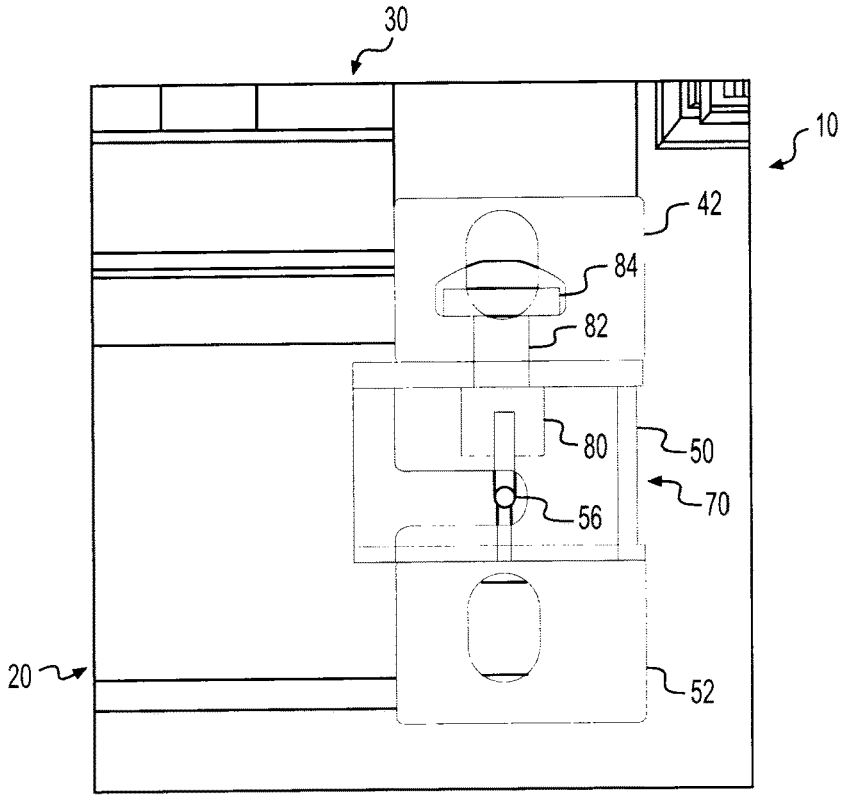
FIG. 9 is a side elevation detail of the new two-piece container with a vertical lock shown cutaway in an unlocked position.

FIG. 8 is a perspective view detail and FIG. 9 is a side elevation partially in cutaway of a corner of the new two-piece container 10 with a vertical lock 50 in unlocked position. A locking handle 56 is shown rotated outward in the unlocked position to receive or release an extended lower corner casting 42 of a lid 30. With the handle 56 in an outward, perpendicular position, a lid 30 may be lowered onto the deck 20 or lifted from deck 20 to open the container 10. The handle 56 is returned to the parallel, inward, closed position when the deck is being unloaded or loaded with cargo. The inward position of the handle prevents interference with cargo handling equipment and prevents the handle or lock from being damaged. The handle 56 is moved to the outward, perpendicular, open position before a lid 30 is lowered onto the deck 20.

As shown in the details of FIGS. 8 and 9, deck 20 at each corner has a corner assembly 70 that includes an upper reinforced vertical locking system 50 and a bottom corner casing 52. Each housing of the vertical locking system 50 is welded to a top of a bottom corner casing 52. Lower corner casings 42 on a lid 30 extend slightly downward from the corner posts 40 and from lower edges of the lid 30.

The lower corner casings 42 of the lids 30 extend slightly downward into recesses in the upper corners of the deck 20 above the deck corner assemblies 70. The vertical locking system 50 at each corner of the deck 20 has a twist lock 80 with an upward extending rotatable pin 82. The pin has an oval head 84 which fits into an oval opening in a horizontal plate that is part of the corner casting 42. When the handle 56 is moved outward, the oval head 84 is aligned with the oval opening and the twist lock 80 is unlatched. When the handle 56 is turned parallel to the side of deck 20, the rotatable pin 82 is turned, and the oval head 84 is misaligned with the oval opening, locking the twist lock 80 in the corner casting 42 of lid 30.

Figure 10:
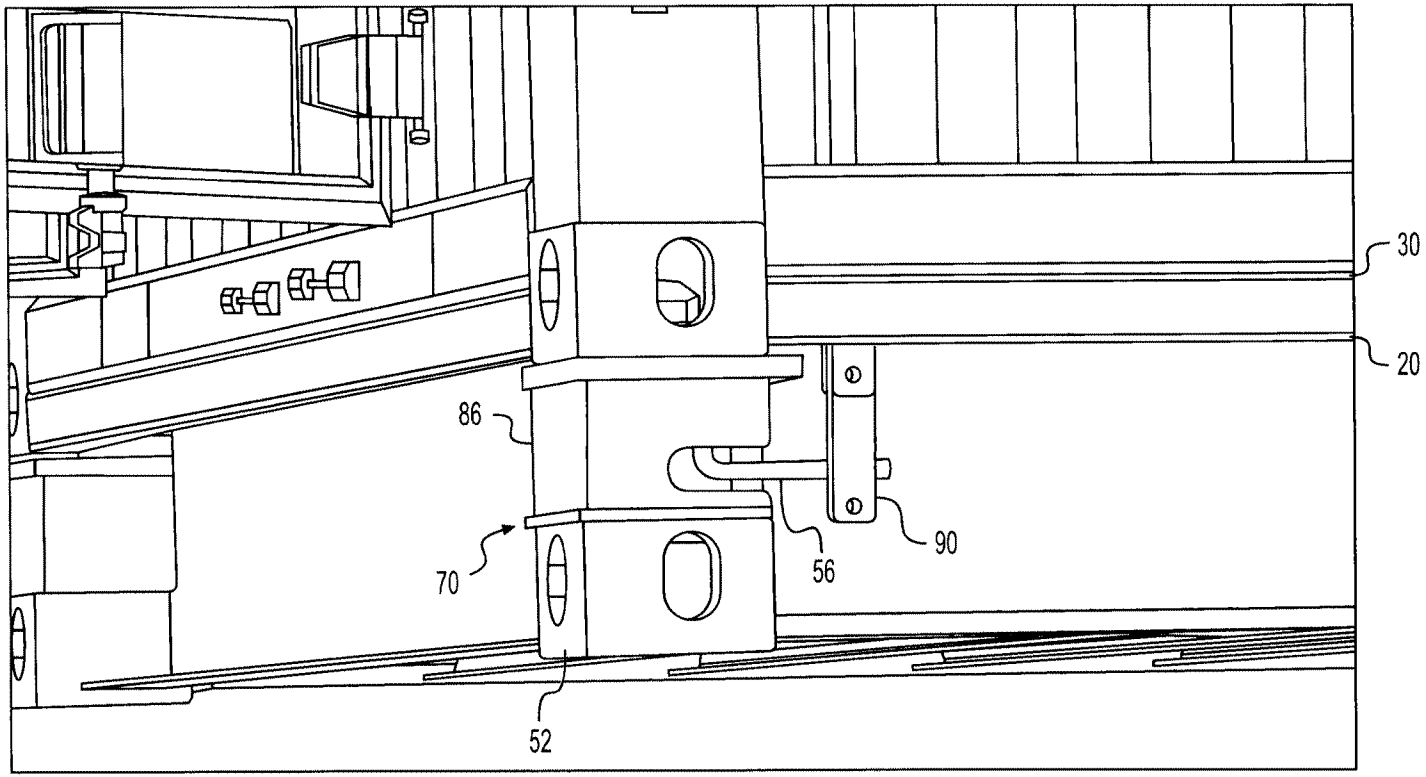
FIG. 10 is a perspective view of the new two-piece container with a vertical lock in locked and secured position. This shows how easily the lid can be locked on and unlocked from the deck with proper access, whenever necessary.

FIG. 10 is a perspective view detail of the new two-piece container 10 with the twist lock handle 56 locked and secured. FIG. 10 shows the twist lock 80 at one corner of the deck 20 with lid 30 in place. A housing 86 for twist lock 80 is welded to the top of corner casting 52. Welded together, the twist lock housings 86 and the corner castings 52 form corner assemblies 70 that act as corner posts of the deck 20. Physical locking devices 90 on vertical locking system handles 56 as shown in FIG. 10 prevent opening by accident or attempted theft.

Figure 11:
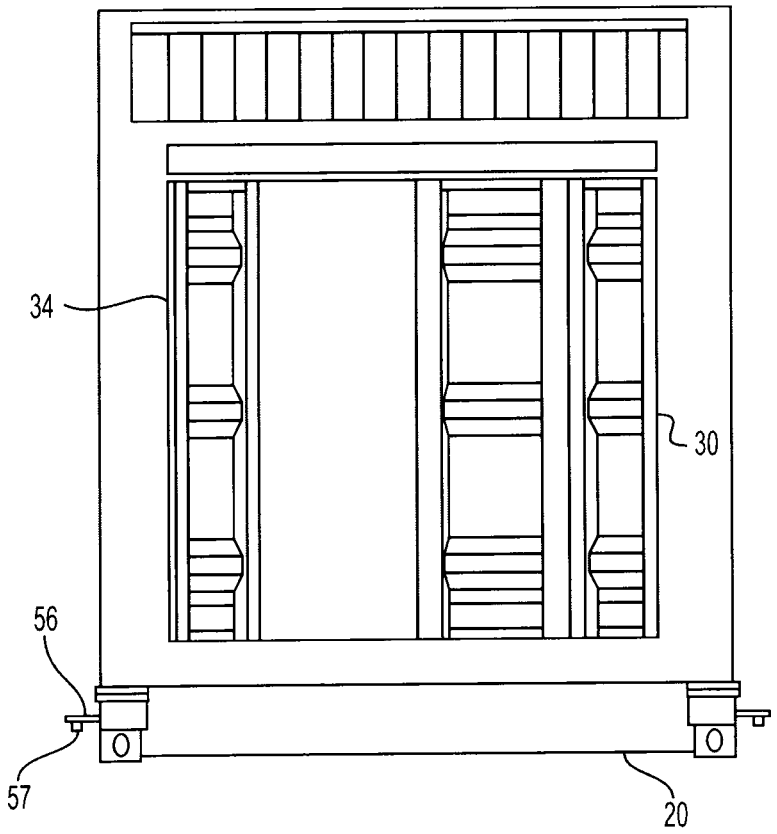
FIG. 11 is an end elevation of the new two-piece container with vertical locks in unlocked positions. When locked together, it is difficult to tell the two pieces separate, giving the impression of formidable protection against theft or entrance.

FIG. 11 shows a container deck and lid end view with unlocked doors open. The lid 30 is shown positioned on deck 20. An access door 34 at one end of the lid is open. The twist lock handles 56 are shown in the open position. Tabs 57 on the handles 56 are used to lock the handles to sides of the deck 20 when the twist locks are closed to prevent unauthorized raising of the lid 30.

Figure 12:
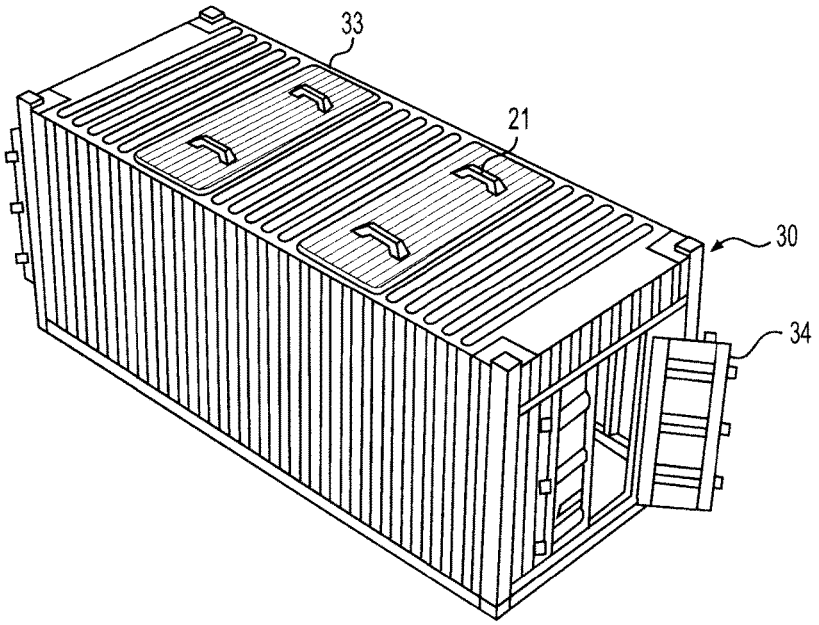
FIG. 12 is a perspective view of the lid with lifting rings on the top and doors at both ends that allow for the lid to be easily removed if and when cargo does not fit through the doors. The rings permit the lifting and lowered of the lid for allowing the cargo to take advantage of the entire space within the container. The size of the cargo is not limited to the size of the door frame.

FIG. 12 is a perspective view of the lid 30 with lifting rings 21 and doors 34 at each end. Lid 30 has lifting rings 31 connected to strengthened parts 33 of the lid's roof. Lifting rings 21 enable the lid 30 to be lifted from the deck 20 with conventional equipment.

Figure 13:
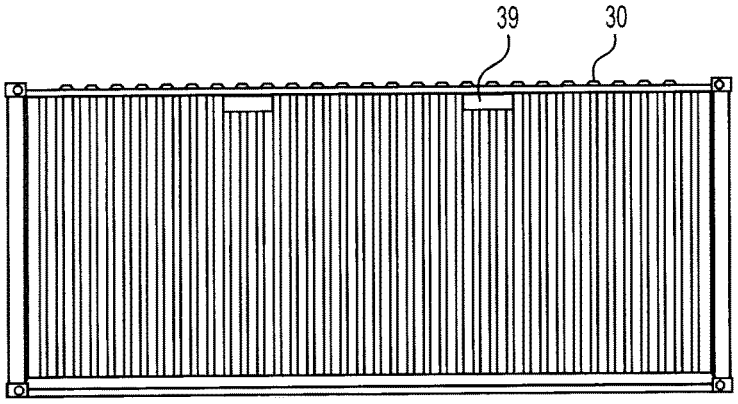
FIG. 13 is a side elevation of the lid with fork tubes for lifting the lid. On the occasion that the whole container needs to be lifted with both pieces connected and locked, the fork tubes are more secure than the rings, permitting greater weight to be lifted.

FIG. 13 is a side elevation of the lid 30 with fork tubes 39 in the lid. Fork tubes 39 extend through sides of the lid 30 near the top to enable the lid 30 to be lifted from a deck when the twist locks are open. Alternatively, the entire new container—the deck and the joined lid—may be lifted using the fork tubes 39.

While the invention has been described with reference to specific embodiments, modifications and variations of the invention may be constructed without departing from the scope of the invention, which is defined in the following claims.

We claim:

1. Apparatus comprising:

a two-piece intermodal shipping container having:

a deck member and a lid member, the deck member further comprising a frame having:

deck member corners, deck member vertical lock housings at upper corners of the deck member, deck member corner castings at lower corners of the deck member, the deck member vertical lock housings and the deck member corner castings being welded together and forming corner assemblies, a floor connected to the frame, the lid member having a bottom surface for engaging the deck member, lid member corners and lid member lower corner castings at bottoms of the lid corners, the lid member lower corner castings being alignable with the deck member vertical lock housings when joining the lid member and the deck member, and lid and deck member twist locks permanently installed in the vertical lock housings adapted for connecting and securing the lower corner castings of the lid member to the top corner vertical lock housings of the deck members.

2. The apparatus of claim 1, wherein the lid member further comprises a lid frame having corner posts connected to the lower corner castings and upper corner castings connected to the corner posts opposite the lower corner castings and side beams connecting the corner posts.

3. The apparatus of claim 2, further comprising sides, end panels and a roof panel connected to the corner posts.

4. The apparatus of claim 3, wherein one of the end walls of the lid member further comprises lockable cargo doors connected to the corner posts.

5. The apparatus of claim 4, further comprising fork lift tubes connected to the lid frame near upper portions of the lid member.

6. The apparatus of claim 1, wherein the floor is recessed in the deck member and the floor is surrounded by the side and end beams.

7. The apparatus of claim 1, wherein the deck member bottom corner castings are alignable and are connectable with castings on carriers or upper corner castings on lid members or upper corner castings of conventional intermodal shipping containers.

8. The apparatus of claim 1, wherein the lid and deck member connectors comprise twist locks permanently installed in housings of the vertical locks on the deck member.

9. The apparatus of claim 1, wherein the deck member vertical locks and bottom corner castings are connected.

10. The apparatus of claim 1, further comprising fork lift openings in the side beams of the frame of the deck member.

11. The apparatus of claim 1, further comprising handles extending from the twist locks through side openings in the vertical lock casings and physical locking devices on sides of the deck member adapted for locking the handles adjacent sides of the deck member and thereby locking the lid member on the deck member and preventing removal of the lid member from the deck member.

12. Apparatus comprising:

an intermodal shipping deck, a frame with corners, side beams, end beams connected between ends of side beams and cross members connected to the side beams, and a floor connected to cross members of the frame, deck corner structures connected to the side beams and the end beams at the corners of the frame, the corner structures further comprising vertical lock casings at upper ends of the deck corner structures, twist locks permanently installed in the vertical lock casings adapted for connecting lower corner castings of lids to the vertical lock casings, and bottom corner castings at lower ends of the corner structures, and the bottom corner castings being connectable to carriers and to upper corner castings of intermodal shipping containers, further comprising:

an intermodal shipping container lid having roof, side and end panels, corners between the side and end panels, and an open bottom, corner posts in the corners and connected to the side and end panels, side and end beams connected to the corner posts, the corner posts having tops and bottoms, upper corner castings connected to the tops of the corner posts, lower corner castings connected to the bottoms of the corner posts, the lower corner castings being connectable to the vertical lock housings of the intermodal shipping deck for providing a complete shipping container, wherein twist locks are permanently installed in the vertical lock housings of the deck for selectively moving between engaging and connecting and disengaging and disconnecting the lower corner castings of the lid with the vertical lock housings of the deck.

13. The apparatus of claim 12, wherein the floor is recessed in the deck member and the floor is surrounded by the side and end beams.

14. The apparatus of claim 12, further comprising cargo tiedown points or rings connected to the side and end beams to secure a load on the deck member.

15. The apparatus of claim 12, further comprising locks connected to the corner structures adapted for locking the twist locks in one twisted position when engaging and connecting the lower corner castings of the lid with the vertical lock casings of the deck.

16. The apparatus of claim 12, further comprising handles extending from the twist locks through side openings in the vertical lock casings and physical locking devices on sides of the deck adapted for locking the handles adjacent sides of the deck and thereby locking the lid on the deck and preventing removal of the lid from the deck.

17. A method comprising:

providing a lid, providing top, end and side panels on the lid, providing corner posts, connecting the roof, end and side panels to the corner posts, providing upper and lower corner castings at tops and bottoms of the corner posts, providing an open bottom of the lid, providing a deck with a frame, providing side beams and end beams and cross beams on the frame, connecting the end beams and cross beams to the side beams, providing a deck on the cross beams, providing vertical lock housings and bottom corner castings welded together and connected to the end and side beams, providing twist locks permanently installed in the vertical lock housings, connecting the permanently installed twist locks in the vertical lock housings to the lower corner housings in the lid, turning the twist locks into engaging positions, and securing the twist locks in the engaging positions.

18. The method of claim 17, further comprising:

permanently mounting the twist locks in the vertical lock casings, extending handles from the twist locks through single openings in sides of the vertical lock casings, moving the handles to sides of the deck to lock the twist locks, and locking the handles in physical locking devices on sides of the deck and preventing removal of the lid.

* * * * *